United States Patent [19]

Yeager

[11] Patent Number: 4,667,838

[45] Date of Patent: May 26, 1987

[54] TAMPER-EVIDENT CLOSURE WITH RIBBED SKIRT

[75] Inventor: Donald F. Yeager, Sarasota, Fla.

[73] Assignee: Sun Coast Plastics, Inc., Sarasota, Fla.

[21] Appl. No.: 851,747

[22] Filed: Apr. 14, 1986

[51] Int. Cl.[4] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,196,818 | 4/1980 | Brownbill | 215/252 |
| 4,278,180 | 7/1981 | Willis | 215/252 |
| 4,322,012 | 3/1982 | Conti | 215/252 X |
| 4,432,461 | 2/1984 | Mumford et al. | 215/252 |
| 4,436,212 | 3/1984 | Alejandro Llera | 215/252 |
| 4,479,586 | 10/1984 | Csaszar | 215/258 |
| 4,497,765 | 2/1985 | Wilde et al. | 215/252 X |
| 4,503,985 | 3/1985 | Swartzbaugh et al. | 215/252 |
| 4,526,282 | 7/1985 | Dutt et al. | 215/252 |
| 4,529,096 | 7/1985 | Chartier et al. | 215/252 |
| 4,552,328 | 11/1985 | Dutt et al. | 249/67 |

*Primary Examiner*—Donald F. Norton

*Attorney, Agent, or Firm*—Jones, Tullar & Cooper

[57] ABSTRACT

An improved tamper-evident closure cap assembly for a container is disclosed. The closure cap assembly includes a breakaway skirt portion molded as a unitary part of the main body of the cap. The skirt incorporates a lower annular ring which engages a corresponding tamper bead on a container to tear the skirt portion away from the cap upon removal of the cap from the container. An annular band extends below the ring at the outer circumference of the skirt, forming an angled channel below the ring and inside the annular band. A plurality of spaced ribs span the channel from the ring to the band to strengthen the ring while allowing expansion of the skirt during capping operations.

14 Claims, 3 Drawing Figures

TAMPER-EVIDENT CLOSURE WITH RIBBED SKIRT

BACKGROUND OF THE INVENTION

The present invention relates, in general, to tamper-evident closures of the type described in U.S. Pat. No. 4,526,282, and in U.S. Pat. No. 4,552,328, both assigned to the assignee hereof. More particularly, the present invention is an improvement over the cap assembly disclosed in the aforesaid patents, and provides a structure which is more easily removed from the mold in which it is formed, and which is more easily applied to threaded containers without damage to the tamper-evident skirt.

Tamper-evident closure caps for containers are well-known, and are increasingly in demand for a wide variety of applications. A recurring problem in the production of such caps is the difficulty in making them sufficiently strong that they can be removed from a mold intact, and will remain intact during handling, shipment, and application to a container, yet still be sufficiently weakened where the tamper-evident skirt portion is attached to the cap that the skirt portion will always tear away from the cap whenever the cap is removed from its container. This problem has led to a wide variety of cap designs, has led to a variety of techniques for applying the caps to the container so as to compensate for design flaws dictated by manufacturing considerations, and has led to the design of complex mold configurations to enable the caps to be removed intact from the molds after they are formed. Such difficulties have adversely affected the cost of manufacturing such caps, particularly when they are made of plastic or other synthetic materials. Thus, in some cases the caps must be cut and heated after the molding step, the cutting being done to produce a weakened area between the cap and depending security ring, and the heating being done to deform the security ring onto the container. In other cases, the prior art suggests that the removal of a molded cap from its mold cavity can be facilitated by connecting the lower tamper-evident skirt to the upper cap portion in such a way that the inside diameter of the skirt is equal to the outside diameter of the cap. Although this does allow easy removal of the device from the mold, it also serves to increase the size of the mold and further requires a deformation step after the cap is placed on a container to ensure that the security ring engages the container. It has also been proposed to form the weakened area between the tamper-evident skirt and the cap by producing an annular V-shaped groove. However, the molding of such a cap requires a tool having complex cams and angle pins which increase the complexity and thus the cost of the mold. All of the foregoing factors adversely affect the cost of manufacturing closure caps with tamper-evident skirts, and applying such caps to containers.

Because manufacturing techniques impose restrictions on the shape of a cap, it is desirable to provide a tamper-evident closure cap design which is cost effective from the manufacturing standpoint. This involves a cap design which is easy to apply to a container and which is also effective to provide evidence of cap removal, while at the same time permitting a tool design which would be relatively simple and inexpensive, consistent with reliable manufacture of the cap. Easy application of the closure to a container is essential if costs are to be reduced, and if damage to the caps is to be avoided. Thus, it is desirable to avoid the cutting and heat-shrinking methods which have been used in prior devices, but to do this, it is necessary to provide a cap having a tamper-evident skirt that is of the final desired size. This has been a problem with prior designs, since in placing the cap on a container, the skirt portion must expand to allow it to fit over the container finish threads and the tamper-evident retainer bead. Preferably, such caps are merely pressed onto the container, although that may be threaded on, with the tamper-evident skirt portion snapping over the tamper bead on the container without damaging the skirt portion. With prior designs, expansion of the skirt portion has often led to its fracturing, rendering the cap unusable, or has caused the skirt portion to stretch out of shape, requiring heating to return it to its initial size. Occasionally, the skirt catches on the container threads during application, and folds under, rather than expanding, thus ruining the cap. Sometimes the pressure required to seat the cap on the container will fracture the connectors which fasten the skirt to the cap, so the cap becomes unusable.

It is, therefore, desirable to provide a tamper-evident closure cap which is capable of being applied to a container over the finish threads and tamper-evident bead to provide a tamper-evident closure without the need for additional application steps and without the danger of fracturing the tamper-evident skirt portion.

SUMMARY OF THE INVENTION

It is an object of the present invention to provide an improved closure cap with a tamper-evident skirt portion which is capable of being applied to a container directly without damage to the skirt portion, and without requiring subsequent heat-shrinking steps.

The closure cap assembly of the present invention includes a conventional main cap having a top and a depending annular side wall. A tamper-evident element, or skirt portion, extends downwardly from the bottom edge of the side wall of the closure cap. The skirt portion is connected to the side wall at a weakened region which is formed at the interface with the side wall, and which is designed to break easily upon removal of the cap to leave the skirt portion on the container. The skirt includes a transversely inwardly projecting annular ring formed near its lower edge and a downwardly depending annular band below the ring portion, the band and the ring forming an inwardly and downwardly facing annular channel around the inner periphery of the skirt. A plurality of spaced, thin support ribs span the channel from the annular ring to the band, the ribs being generally triangular to form a downwardly and outwardly angled surface. The upper surface of the annular ring is shaped to engage the lower edge of a corresponding tamper bead formed on the container, engagement of the ring against the bead serving to fracture the weakened area between the skirt portion and the closure cap during removal of the cap.

The annular ring formed on the skirt extends horizontally inwardly a distance sufficient to ensure that the inner edge thereof will engage the surface of the container; however, the ring is relatively thin in the vertical dimension. This thinness would make the ring relatively weak and flexible, and unable to function to tear away the skirt portion, except that it is strengthened by the vertical ribs which extend downwardly and outwardly between the bottom of the ring and the depending annular band which forms the bottom of the skirt portion.

The skirt portion also includes an external annular shoulder located near its top, as well as an inwardly and upwardly tapered surface above the external shoulder. The external shoulder and the tapered surface facilitate removal of the closure cap from the forming mold after a molding operation is completed, preferably by means of a stripper as set forth in the aforesaid U.S. Pat. Nos. 4,552,328 and 4,526,282. The stripper ring engages corresponding shoulders on the cap and on the skirt to exert sufficient upward force to remove the entire cap assembly from the mold ring without breaking the skirt portion away from the cap side wall. A certain amount of outward flexing of the skirt is required to enable the annular ring to move over the surface of the mold core, but this flexing is facilitated by making the ring sufficiently thin to allow radial expansion of the skirt and of the ring itself, and by using a resilient material, so that the cap and skirt can be removed from the mold without damage.

The angled bottom surfaces of the spaced ribs on the skirt and the expandability of the annular ring due to the thinness and the resilience of the material allow the cap and skirt assembly to be pressed onto the top of a container by a conventional capping machine without damage to the tamper-evident skirt portion. Thus, the angled bottom surfaces of the ribs guide the skirt outwardly and over the threads and over the tamper bead on the container finish, the spacing between the ribs, and the thinness of the annular ring and the depending annular band allowing the skirt to flex easily over those projections without permanent deformation, so that when the cap is in place the tamper-evident skirt portion returns to its initial configuration without damage. When the cap is removed from the container by unthreading it, the skirt portion is moved upwardly until the upper surface of the annular ring engages the lower surface of the container tamper bead. This prevents further upward motion of the skirt and causes the skirt to fracture at the weakened portion and separate from the cap body.

Although the annular ring on the skirt portion is thin, the spaced ribs provide sufficient rigidity to ensure that the ring will not fold down and allow the skirt to ride upwardly over the tamper bead. This rigidity is provided without the mass of material required in former configurations so that strength is maintained while using less material, providing a tamper-evident ring that is cheaper to manufacture and less wasteful of materials. The support ribs are spaced evenly around the circumference of the skirt to assure even stretching of the annular ring and of the depending annular band upon application of the cap assembly to a container. This even distribution insures that there will not be excessive stretching in any one part of the skirt that might lead to failure of the cap. The spacing of the ribs and the thickness of the skirt material are balanced so that rigidity and skirt hoop strength are retained to insure proper breakaway characteristics of the skirt, without the skirt itself fracturing upon removal of the cap, while insuring sufficient elasticity so that the cap can be applied to a container without the skirt portion catching on the container finish and collapsing inwardly instead of sliding smoothly onto the container.

Proper application of the cap assembly is facilitated by the angled ribs, which provide approximately a 45° entry angle. This allows the cap to be applied with less pressure, again preventing premature breaking of the weakened area. Preferably, the support ribs are located in alignment with the gates through which molten plastic is supplied to the mold during manufacture of the cap assembly. The shape of the ribs facilitates the flow of plastic into the annular ring and insures proper manufacture of the device.

In a preferred form of the invention, 16 ribs are provided around the circumference of a one-inch diameter cap, with each rib being about 60 percent of the thickness of the skirt, or about 0.015 inch thick for a one-inch cap. A larger number of ribs would be provided for a larger diameter cap, but the thickness of the ribs remains at about 60 percent of the skirt thickness. Tests of a cap assembly manufactured in accordance with the foregoing resulted in 100 percent successful removal of the cap assembly from the mold and application to threaded containers, whereas prior devices utilizing solid beads around the periphery of a tamper-evident skirt resulted in about a 15 percent failure rate.

BRIEF DESCRIPTION OF THE DRAWINGS

The foregoing and additional objects, features, and advantages of the present invention will be more fully understood from a consideration of the following detailed description of preferred embodiment of the invention, taken in conjunction with the accompanying drawings, in which.

DESCRIPTION OF PREFERRED EMBODIMENT

Figure 1:
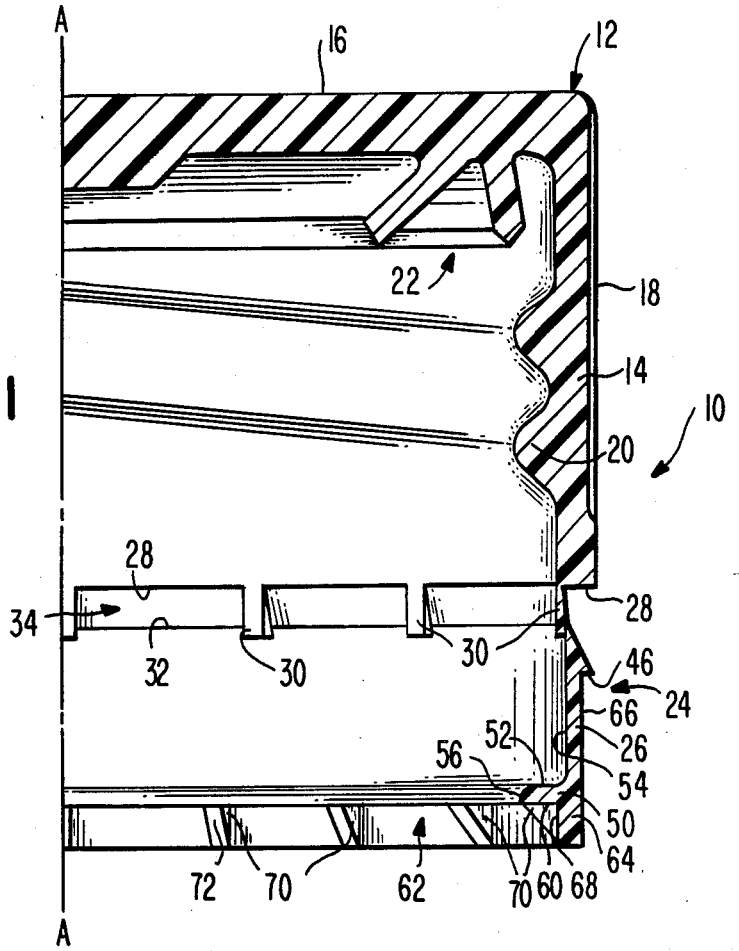
FIG. 1 is a partial view in cross section of a closure cap assembly incorporating a tamper-evident skirt constructed in accordance with the present invention.
Figure 2:
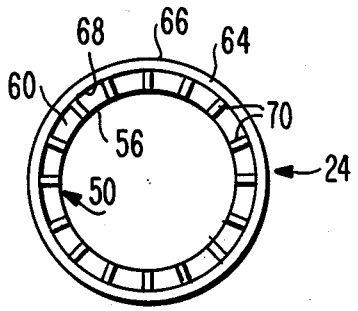
FIG. 2 is a bottom plan view of the closure cap of FIG. 1, showing the spaced support ribs for the skirt.

Turning now to a more detailed consideration of the present invention, there is illustrated in FIG. 1 a closure cap assembly 10 having a longitudinal axis A—A. The cap assembly, which may be formed of a plastic material such as polyethylene, includes a cap portion 12 having an annular side wall 14 and a transverse top portion 16. The annular side wall may include serrations 18 on its exterior surface (shown in FIG. 1, but not in FIG. 3) and a conventional thread 20 on its interior surface. An annular flanged sealing element 22 may be formed as a part of the cap 12 and preferably is of the type shown in U.S. Pat. No. 4,143,785. The sealing element 22 can be constructed in accordance with the two-shot design shown in U.S. Pat. No. 4,308,965, or the cap can be formed with conventional liners in place of the flanged sealing elements.

Connected to, and formed as a continuation of, the side wall 14 is a tamper-evident skirt portion generally indicated at 24. The skirt portion is formed unitarily with the cap during manufacture of the assembly, the cap 12 and the skirt 24 forming the cap assembly 10. The tamper-evident skirt 24 includes an annular wall portion 26 connected to the bottom edge 28 of cap 12 by means of a plurality of frangible spaced connectors 30. The connectors support the skirt portion 24 so that its top edge 32 is spaced below the bottom edge 28 of the cap portion, thereby forming an annular weakened region 34 where the skirt portion 24 can be broken away from the cap 12. To facilitate this breaking away, the connectors 30 are tapered, with the narrowest portion of each connector being located at the edge 28 so that the narrowed region at the interface with edge 28 will fracture easily when the cap is removed from a container on which it has been placed, thereby leaving the skirt portion 24 on the container as evidence of tampering.

Figure 3:
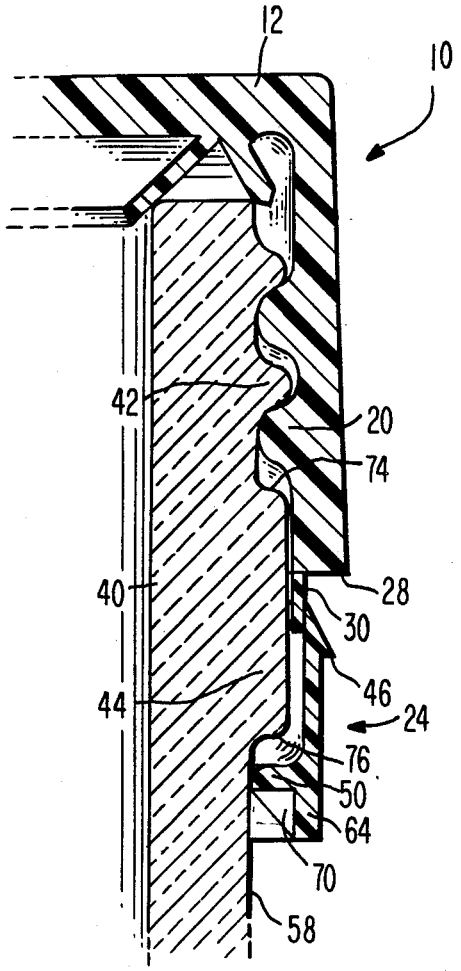
FIG. 3 is a partial view in cross section of the closure assembly of FIG. 1, shown mounted on a container.

The manner in which the cap and skirt portions 12 and 24 are mounted on a container such as the neck portion of a bottle or jar 40, is illustrated in FIG. 3. As there illustrated, the threads 20 on the cap engage corresponding threads 42 on the finish of the container 40, while the skirt 24 fits over, and is adapted to engage, a container tamper bead 44, as will be explained in detail hereinbelow.

The skirt portion 24 is formed with an exterior, transversely extending annular shoulder 46 which is located for engagement by a mold stripper ring in the manner described in the aforesaid U.S. Pat. No. 4,552,328. Shoulder 46 and the bottom surface 28 are both engaged by the stripper ring so that both the cap 12 and the skirt 24 are stripped from the forming mold at the same time to prevent breakage of any of the connectors 30.

Instead of the solid bead which is conventionally formed at the bottom of the skirt portion of many tamper-evident cap assemblies, the present invention is directed to the provision of a relatively thin, transversely inwardly extending annular ring portion 50 unitarily formed with the skirt portion 24. The ring portion 50 has a curved upper surface 52 which at one end merges smoothly into the interior surface 54 of wall portion 26 and which at the other end terminates at a generally vertical inner edge 56. The diameter of the ring 50 at the inner edge 56 is substantially the same as the outer diameter of the container 40 at the container outer surface 58 below tamper bead 44, and thus is adapted to engage the outer surface 58 (FIG. 3) of the container wall 40 when the cap assembly is in place. In cases where the diameter of bead 44 is greater than the diameter of the threads 42, the diameter of ring 50 at inner edge 56 must be sufficiently large to perform in the same manner. The bottom surface 60 of ring 52 is a generally flat, transversely extending surface which forms the upper wall of a downwardly and inwardly facing channel 62 formed at the bottom of skirt 24. The outer wall of channel 62 is formed by a depending annular band 64, the outer surface of which is a continuation of the outer surface 66 of the skirt side wall 26. The inner surface 68 of the band 64 is substantially vertical and cooperates with the surface 60 to form channel 62. It is noted that the band 64 is slightly thicker than the wall 26 in order to provide hoop strength to the lower part of the skirt 24 and to accommodate the flexing of the annular ring 50 when it passes over the threads and tamper bead upon placement of the cap onto a container.

Spaced around the circumference of skirt 24 and spanning the channel 62 are a plurality of triangular support ribs 70 which are angled across the channel from the inner edge 56 downwardly and outwardly to the bottom of inner surface 60 to provide a downwardly and outwardly sloping surface 72 on each rib. These surfaces 72 are preferably at about a 45 degree angle with respect to the cap center axis A—A, and provide a "lead in" for the tamper-evident skirt 24 when the cap is being applied to a container. Ribs 70 are relatively thin and widely spaced around the circumference of skirt 24 with the exact number and thickness of the ribs depending upon the diameter of the cap, and their thickness being about 60 percent of the thickness of the wall 26 of skirt 24. For a nominal one-inch diameter cap, it is preferred that 16 ribs be provided around the circumference of skirt 24, with each rib being 0.015 inch thick. In such a device, the band 64 may be 0.020 inch thick, the channel may be 0.040 inch wide from surface 68 to edge 56, and ring 50 may be 0.020 inch thick in the vertical direction. The inner diameter of ring 50, at edge 56, may be approximately one inch so that it fits around a nominal one-inch diameter container.

The channel-shaped construction of the bottom portion of skirt 24, including the ring 50, the band 64, and the ribs 70, substantially reduces the amount of material required to manufacture the skirt without adversely affecting the tamper-evident functioning of the skirt. The reduction in material allows the skirt to stretch so that it can be placed on a container without the need for subsequent heat shrinking, while the ribs provide sufficient rigidity to insure that the breakaway function of the skirt is not impaired.

In operation, the cap assembly 10 preferably is formed in a mold of the type described in the aforesaid U.S. Pat. No. 4,552,328, and is removed from the mold by the use of a stripper ring engaging surfaces 28 and 46, as described in that patent. Removal of the assembly from the mold is facilitated by the construction of the lower portion of skirt 24, the reduced amount of material allowing the plastic in the ring 50 and the band 64 to stretch radially outwardly as it is stripped from the mold, without breaking either the skirt or the connectors 30. The cap assembly may then be placed on a container, as by means of a conventional capper, which positions the cap assembly over the mouth of a container such as that illustrated at 40 in FIG. 3. As the cap assembly 10 is pressed downwardly by the capper, the lead-in surfaces 72 of ribs 70 engage the threads 42 of the container and cause the lower portion of the skirt to expand radially outwardly so that the diameter of the inner edge 56 for ring 50 will pass over the threads. The ribbed design of the skirt produces an evenly distributed stretching of the skirt around its circumference so that neither the ring 50 nor the band 64 will fail during this operation. In similar manner, the lead-in surfaces cause the skirt to pass over the top edge 74 of the container tamper bead 44 and, as the cap is pressed down on the container, the skirt snaps over the lower edge 76 of the bead into the position illustrated in FIG. 3. The resilient characteristic of the material, together with the structure of the skirt, ensure that the skirt will stretch over the finish of the container and will return to the position illustrated in Fig. 3 without any need for heat shrinking or other operations on the cap. Once the cap is in position, removal thereof, as by unthreading the cap portion 12, will raise the skirt 24 so that the top surface 52 of annular rib 50 will strike the lower surface 76 of bead 44. The surfaces 52 and 76 are matched, with the contacting surfaces being within a few degrees of the horizontal so that further upward motion of the skirt is prevented. Further untwisting of the cap portion will then fracture the connectors 30, leaving the skirt on the container as an indication that the container has been opened.

Thus there has been described a new and improved skirt structure for tamper-evident cap assemblies which not only reduces the amount of material required for the manufacture of such devices, but also facilitates the manufacturing process and the assembly process. The structure provides these advantages without any reduction in the effectiveness of the tamper-indicating function, while tests have shown that the loss rate due to breakage during the stripping of caps from the mold or placement of caps on containers has been substantially reduced from about 15 percent breakage to close to 0 percent breakage. Although the present invention has been described in terms of a preferred embodiment, it will be apparent that numerous modifications and variations may be made without departing from the true spirit and scope thereof, as set forth in the accompanying claims:

What is claimed is:

1. A unitary, molded closure cap assembly capable of application to a container to provide tamper-evident security, comprising:

a substantially rigid cap member having a cylindrical cap side wall and a transverse top wall integrally formed therewith, said side wall defining an open end adapted to receive the neck of a container for closure thereof;

an annular skirt portion;

a plurality of spaced, frangible connectors attaching said skirt portion to the lower end of said cap side wall, said skirt portion including:

(a) a cylindrical skirt side wall attached at its top to said spaced, frangible connectors;

(b) a transversely inwardly extending annular ring formed at the bottom of said skirt side wall, said ring having a top surface and a bottom surface melting at an inner edge;

(c) an annular band depending from, and having the same outer diameter as, said skirt side wall, said band having an inner surface which cooperates with said ring bottom surface to form a circumferential channel at the bottom of said skirt; and (d) a plurality of thin, widely spaced support ribs bridging said channel.

2. The closure cap assembly of claim 1, wherein said annular ring is generally rectangular in cross section, having a short dimension in the vertical direction and a relatively long dimension in the horizontal direction, whereby said ring is flexible, but is held in position by said support ribs.

3. The closure cap assembly of claim 1, wherein each of said ribs includes a downwardly and outwardly sloping lead-in surface.

4. The closure cap assembly of claim 1, wherein said ring and said band are sufficiently resilient to allow said assembly to be placed on a container without damage to said skirt or said connectors.

5. The closure cap assembly of claim 1, where said ribs are spaced apart sufficiently to permit horizontal expansion of said ring and said band to allow said assembly to be placed on a container and to allow said skirt to pass over the container threads and tamper bead without damage to said skirt or said connectors, said skirt thereafter returning to its initial diameter due to the resilience of the skirt material.

6. The closure cap assembly of claim 5, wherein said ribs are equally spaced around the circumference of said skirt to prevent fracture of said skirt upon expansion of said ring and said band.

7. The closure cap assembly of claim 6, wherein each of said ribs is on the order of 0.015 inch thick.

8. The closure cap assembly of claim 7, wherein the number of ribs in said channel increases with increasing diameter of said cap.

9. The closure cap assembly of claim 8, wherein each of said ribs is generally triangular and includes a downwardly and outwardly sloping lead-in surface.

10. The closure cap assembly of claim 9, wherein said circumferential channel opens downwardly and inwardly.

11. The closure cap assembly of claim 10, wherein said annular ring is generally rectangular in cross section, and has a shaped upper surface adapted to engage a tamper bead on the finish of a container to prevent removal of said skirt from the container.

12. A unitary, molded closure cap assembly adapted to be applied to a container having a neck portion and a finish on the neck which includes threads and a tamper bead, comprising:

a substantially rigid cap member having internal threads and adapted to receive and threadedly engage the neck portion of a container;

an annular, tamper-evident skirt portion;

a plurality of spaced, frangible connectors attaching said skirt portion to the lower end of said cap, said skirt portion being adapted to pass over a container tamper bead when said cap is applied to a container and to be retained by the tamper bead upon removal of the cap, said skirt portion including:

(a) an upper portion attached to said connectors;

(b) a lower portion including an inwardly extending annular ring and a downwardly extending annular band forming a downwardly and inwardly facing channel, and a plurality of thin, widely spaced support ribs in said channel, each rib having a downwardly and outwardly sloping lead-in surface to facilitate application of the cap assembly to a container, said annular ring having an upper surface adapted to engage a container tamper bead upon removal of the cap assembly from a container to prevent removal of said skirt therefrom.

13. The closure cap assembly of claim 12, wherein said ring and said band are resilient to allow radial expansion of said skirt portion upon application of the cap assembly to a container, whereby said skirt portion will pass over any container threads and/or tamper beads without damage upon application of the cap assembly to a container.

14. The closure cap assembly of claim 13, wherein said annular ring is thin in a vertical direction to allow expansion in a horizontal direction, said ring being retained in position in the vertical direction by said ribs.

* * * * *

UNITED STATES PATENT AND TRADEMARK OFFICE

CERTIFICATE OF CORRECTION

PATENT NO. : 4,667,838

DATED : May 26, 1987

INVENTOR(S) : Donald F. Yeager

It is certified that error appears in the above-identified patent and that said Letters Patent is hereby corrected as shown below:

Claim 1, column 7, line 29, "melting" should be --meeting--.

Signed and Sealed this

Eighteenth Day of August, 1987

*Attest:*

DONALD J. QUIGG

*Attesting Officer*

*Commissioner of Patents and Trademarks*